US005257033A

United States Patent [19]

Roche

[11] Patent Number: 5,257,033

[45] Date of Patent: Oct. 26, 1993

[54] TRANSMITTER WITH A REDUCTION OF POWER OF SIGNALS TRANSMITTED AT HARMONICS

[75] Inventor: Thomas Roche, Spotslyvania, Va.

[73] Assignee: Design Tech International, Inc., Springfield, Va.

[21] Appl. No.: 685,674

[22] Filed: Apr. 16, 1991

[51] Int. Cl.[5] ..... H01Q 11/12; H01Q 1/24

[52] U.S. Cl. ..... 343/742; 343/702; 343/744; 343/867

[58] Field of Search ..... 343/742, 702, 866, 867, 343/856, 855, 744; 455/274, 296, 282, 283, 284, 114, 129, 91

[56] References Cited

U.S. PATENT DOCUMENTS

| | | | |
|---|---|---|---|
| 3,550,137 | 12/1970 | Kuecken | 343/856 |
| 4,862,181 | 8/1989 | Ponde De Leon et al. | 343/702 |
| 5,030,963 | 7/1991 | Tadama | 343/702 |
| 5,166,646 | 11/1992 | Avanic et al. | 333/193 |

*Primary Examiner*—Donald T. Hajec

*Assistant Examiner*—Hoanganh Le

*Attorney, Agent, or Firm*—Oblon, Spivak, McClelland, Maier & Neustadt

[57] ABSTRACT

A transmitter has a transmitting antenna which may be formed as a loop etched onto a printed circuit board. The transmitting system includes an oscillator which generates a signal at a fundamental frequency to be transmitted and which is fed to a radiating loop or transmitting antenna. Located inside of this loop, and which may also be etched onto the printed circuit board, is an inner passive loop which is in series with a capacitor or which is connected to the outer loop by the capacitor. The size of the capacitor and the printed inner loop operate to remove harmonics of the fundamental frequency generated by the oscillator. In this way, the present invention operates to transmit a signal at a fundamental frequency which is at a high power level while lowering the power of signals unintentionally transmitted at harmonics of this fundamental frequency by utilizing a circuit which is simple, inexpensive and compact.

19 Claims, 4 Drawing Sheets

TRANSMITTER WITH A REDUCTION OF POWER OF SIGNALS TRANSMITTED AT HARMONICS

BACKGROUND OF THE INVENTION

1. Field of the Invention

The present invention is directed to a compact, simple and inexpensive RF (radio frequency) transmitter which can transmit a signal at a fundamental frequency at a high power level while at the same time reducing the power of signals transmitted at harmonics of the fundamental frequency.

2. Discussion of the Background

When utilizing an oscillator to generate a transmitting signal, transmitting signals are generated not only at the fundamental frequency $F_0$ of the oscillator, but, although not intentional, are also generated at harmonics of the fundamental frequency $F_2$, $F_3$, $F_4$. . . ($F_2$ represents the first harmonic, $F_3$ represents the second harmonic, etc.).

Prior to being able to utilize and market a consumer electronics transmitter, the transmitter must meet Federal Communications Commission (FCC) approval and standards. When transmitting at certain fundamental frequencies $F_0$, FCC standards typically require that the power of the signal transmitted at the fundamental frequency $F_0$, and at the harmonics of that fundamental frequency $F_0$, fall below certain predetermined thresholds. Typically, the maximum power threshold requirements at the harmonics will decrease sharply. FIG. 1 is a graph showing the type of threshold limits that would typically be required by FCC regulations.

It is generally desirable to maximize the ratio of the power of the transmitted signal at its fundamental frequency $F_0$ to the power of the harmonics, to thereby maximize its range of transmission. However, it is very difficult to maximize the power of the transmitted signal at its fundamental frequency $F_0$ and at the same time maintain the power of the transmitted signal at its harmonics $F_2$, $F_3$ and $F_4$ below the maximum allowable level set by the FCC standards.

Without any system to reduce the power level of signals transmitted at the harmonics of the fundamental frequency $F_0$ the power levels of the transmitted signal would resemble that shown in FIG. 2. As shown in FIG. 2, the power of the signal transmitted at the fundamental frequency $F_0$ is below the appropriate threshold but the power of the signals transmitted at the harmonics of the fundamental frequency exceed their appropriate thresholds (the power of the signals transmitted at the frequencies for $F_0$, $F_2$, $F_3$ and $F_4$ are shown by the bars at those locations on the axis).

One method of overcoming this problem is to employ a plurality of filter circuits in conjunction with the oscillating circuit. These filter circuits will then operate to filter out the signals transmitted at the harmonics $F_2$, $F_3$, $F_4$, etc. However, this solution has a drawback in that these filter circuits are expensive, consume a large amount of space and thus result in an enlargement of the circuit as a whole.

An alternate solution to reduce the power levels of the transmitted signal at the harmonics $F_2$, $F_3$, $F_4$, is to reduce the power of the transmitted signal as a whole. That is, by reducing the overall power of the transmitted system, the power in the signal at the fundamental frequency $F_0$ and at the harmonics $F_2$, $F_3$, and $F_4$ will all be reduced and will thus fall below the maximum allowable thresholds set by FCC standards. This solution is shown in FIG. 3 where it can be seen that the signals transmitted at harmonics $F_2$, $F_3$, and $F_4$ are within acceptable FCC thresholds. However, a sacrifice is here made in that the signal transmitted at the fundamental frequency $F_0$ is much weaker than is allowable. Thus, the obvious drawback of such a compromise is that the power level of the signal at the fundamental frequency $F_0$ is also reduced thereby diminishing the range and signal-noise ratio of the transmission signal.

SUMMARY OF THE INVENTION

Accordingly, one object of the present invention is to provide a novel transmitting circuit which is simple, inexpensive and compact, in which the fundamental frequency of a transmitting signal $F_0$ can be maintained at a high power level while at the same reducing the power of the signals unintentionally transmitted at harmonics of that fundamental frequency to acceptable levels.

The present invention is directed to a system in which the radiating element or transmitting antenna is a loop antenna and particularly where the loop antenna is a loop etched onto a printed circuit board.

The present invention achieves these objects by utilizing a loop antenna which may be etched on a printed circuit board as a radiating element or transmitting antenna and by employing a second passive loop formed inside of this first loop. Further, connected in series with this second passive loop is a capacitor. The value of the capacitor will be chosen such that an antiresonant condition of the harmonic frequencies of the fundamental frequency $F_0$ is set up to thereby cancel signals transmitted at these harmonics.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2 represents a typical power profile of a conventional transmitter at predetermined frequencies without any filtering operations or the like;

DETAILED DESCRIPTION OF THE PREFERRED EMBODIMENT

Figure 1:
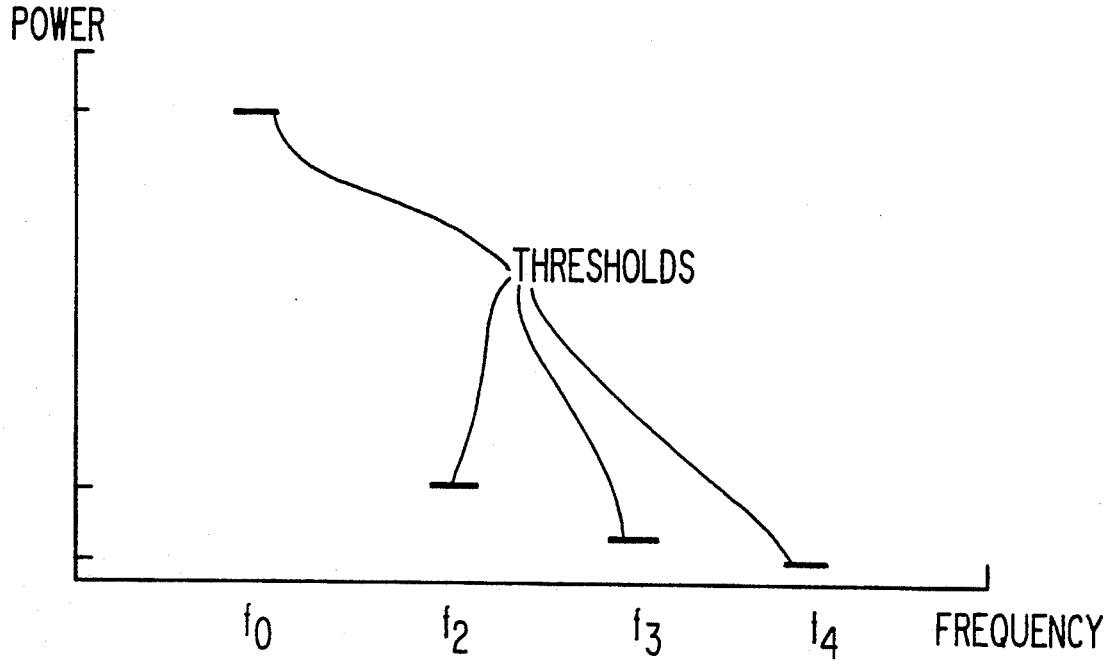
FIG. 1 represents typical standards imposed by the FCC in maximum power permitted at certain frequencies in a transmitter.
Figure 2:
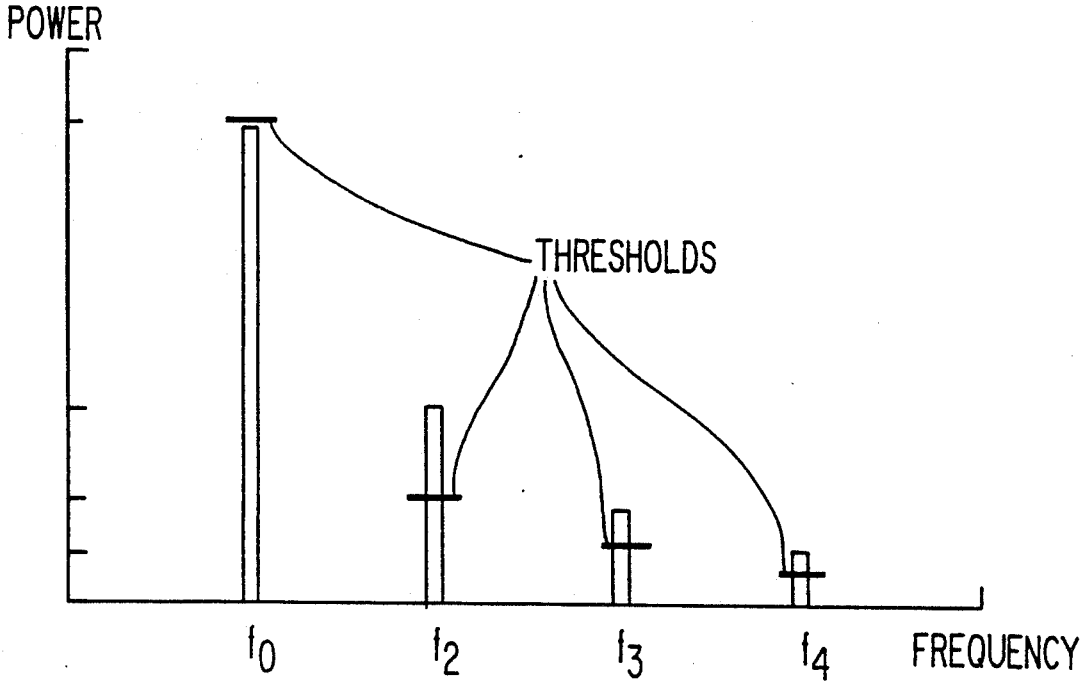
Figure 3:
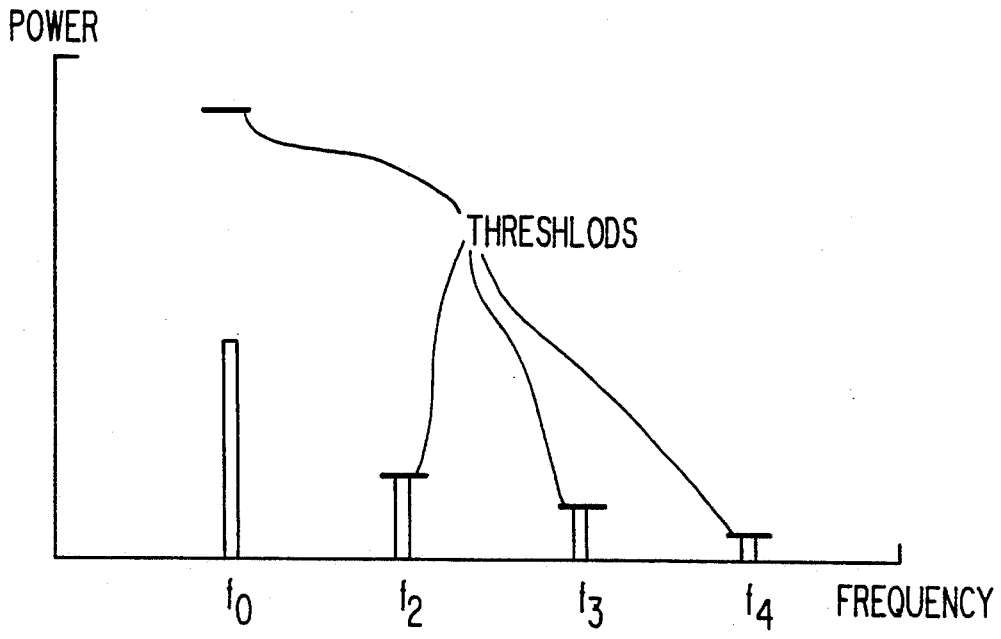
FIG. 3 represents a conventional solution to reducing the power output to acceptable limits.
Figure 4:
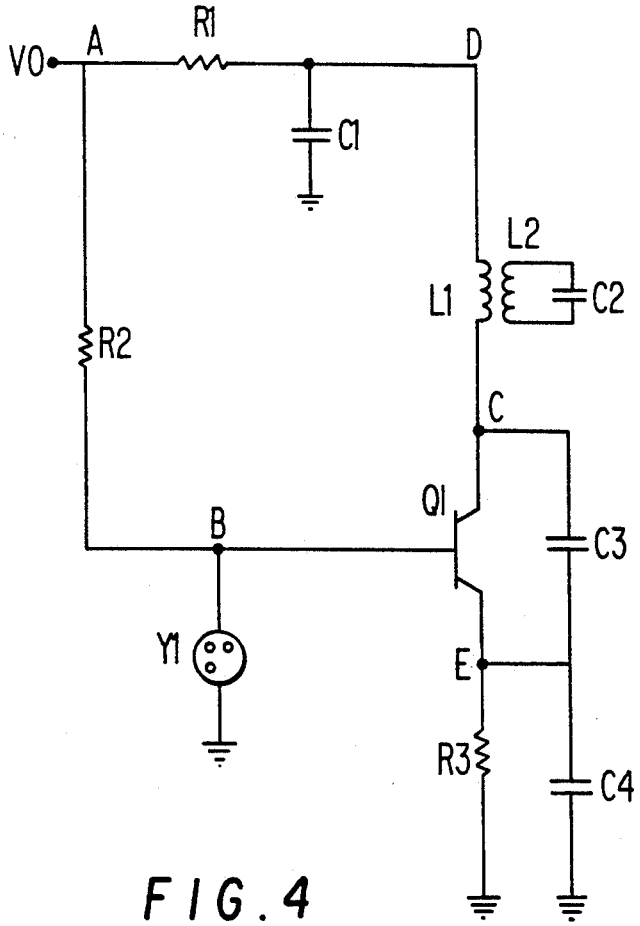
FIG. 4 represents a circuit diagram of a first embodiment of a transmitting system achieving the objects of the present invention.

Referring now to the drawings, wherein like reference numerals designate identical or corresponding parts throughout the several views, and more particularly to FIG. 4 thereof, there is shown a diagram of a first embodiment of a circuit which employs the features of the present invention.

The transmitting system of the present invention consists of a transistor Q1 which has one port of a SAW (surface acoustic wave) resonator Y1 input to its base B. The other port of SAW resonator Y1 terminates at ground. Further, connected between the base of transistor Q1 and a node A is a resistor R2. Also connected to node A is a voltage source V0. A resistor R3 and a capacitor C4 are connected in parallel between the emitter E of transistor Q1 and ground. A capacitor C3 is also connected between the collector C and emitter E of transistor Q1. Connected between node A and a node D is a resistor R1. Further, a bipass cap capacitor C1 is connected between node D and ground. An antenna L1, which also provides an inductive load, is connected between node D and the collector of transistor of Q1. A second loop L2 is connected in series with a capacitor C2. Although not shown in FIG. 4, the inductive coupling between loops L1 and L2 is provided by positioning loop L2 inside of loop L1. This is shown in FIG. 5.

Loops L1 and L2 may be realized as loops which are etched onto a printed circuit board. Loop L1 operates as the radiating element or transmitting antenna of the transmitting system of the present invention. As shown in FIG. 4, loop L2 is passive in that it receives no input power signal.

The frequency of oscillation $F_0$ of the transmitting system will be determined by the SAW resonator Y1 chosen. A typical saw resonator which can be utilized in such a system is an RF Monolithics RK2021. Elements L1, R3, C3 and C4 operate to set up the necessary phase conditions to begin oscillation. Obviously, the values of R3, C3 and C4 will vary based on the particular application of the present invention.

Figure 5:
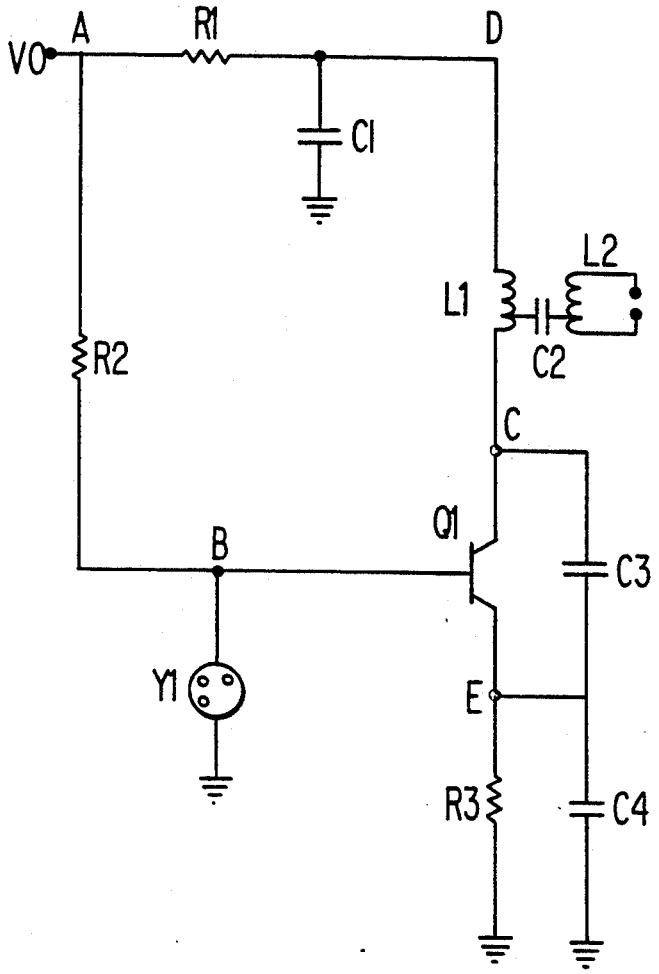
FIG. 5 represents a circuit diagram of a second embodiment of a transmitting system achieving the objects of the present invention.

FIG. 5 shows a second embodiment of a circuit which employs the features of the present invention. The second embodiment of FIG. 5 is similar to the first embodiment of FIG. 4 and differs only in the nature of the passive inner loop L2 and location of capacitor C2. Note that each of the elements of FIG. 5 corresponds to the elements of FIG. 4, thus identical numerals are used, and it is only the locations of the elements which vary.

In the second embodiment of FIG. 5, capacitor C2 is not located in series with inner loop L2, but instead is connected between loop L2 and loop L1. Also, in the area which capacitor C2 would occupy if it was in series with loop L2 is a gap. That is, in this second embodiment inner loop L2 is not a complete loop but instead has a slight gap formed in it. This gap is shown as between points F and G in FIG. 6. However, this second embodiment circuit shown in FIG. 5 functions to produce the same results as the first embodiment circuit shown in FIG. 4.

Figure 6:
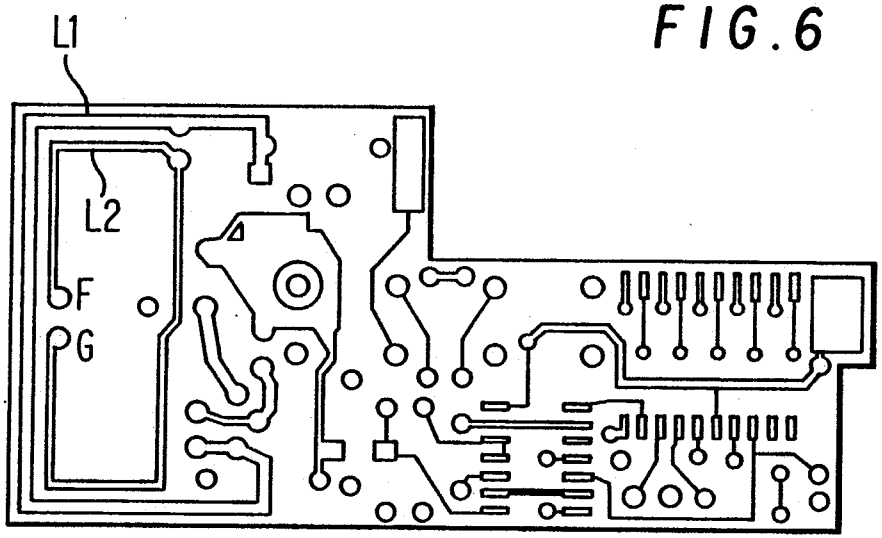
FIG. 6 represents an example of how such systems could be employed on a printed circuit board.

FIG. 6 represents a typical printed circuit board which can incorporate the features of the present invention. As shown in FIG. 6, second passive loop L2 is formed inside of a first radiating loop L1. Further, capacitor C2 (not shown), when implementing the circuit of the first embodiment of FIG. 4, is connected between the points F and G shown in FIG. 6 and is located on the circuit board. As noted above, when implementing the circuit of the second embodiment, capacitor C2 (not shown) will be placed to connect loops L1 and L2 and the space between points F and G will remain open as a gap. As shown in FIG. 6, the dimensions of the inner and outer loops L1 and L2 and total size of the transmitting system can be kept at a minimum by using the device of the present invention.

The passive inner loop L2 and capacitor C2 operate to set up an anti-resonant condition at frequencies that are a multiple of the fundamental frequency $F_0$, i.e., at harmonic frequencies $F_2$, $F_3$, $F_4$, etc. The value of capacitor C2 is chosen to induce signals in the passive loop which are 180° out of phase with the signals generated at the harmonics of the fundamental frequency, to thereby alternate signals transmitted at these harmonics by the radiating loop. The actual dimensions of L2 and the value of the capacitance C2 will be chosen based on the frequency of oscillation $F_0$. In this way, inner loop L2 and capacitor C2 operate to effectively attenuate signals transmitted at the harmonic frequencies of $F_2$, $F_3$, $F_4$, etc. Therefore, the present invention can maintain the fundamental frequency $F_0$ at a high power level while reducing the power of the signals which are transmitted at the harmonic frequencies $F_2$, $F_3$, $F_4$, etc.

As an example, when utilizing a SAW resonator such as the RF Monolithics RK2021 operating at 418 MHz, typical values of the elements used in FIGS. 4 and 5 will be: R1=220 Ω, C1=500 pf, R2-68kΩ, C3=0.5 pf, C4=4.7 pf, R3=1kΩ and C2=4.7 pf.

Thus, in the fundamental frequency of the present invention a signal generated at a fundamental frequency $F_0$ can be transmitted at a high power level while maintaining the signals transmitted at frequencies at the harmonics at a low power level and within acceptable FCC standards. Further, the solution provided by the present invention is simple and inexpensive and still allows for a compact circuit configuration.

Although the second embodiment of the present invention utilizes a capacitor C2 connected between loops Ll and L2, different circuit elements may be used in place of the capacitor at certain frequencies. For example, at lower frequencies a resistor may be used and at higher frequencies a loop may be used.

A typical use of such a transmitting device may be in a transmitter of an automobile security system in which various features of the automobile security system can be remotely controlled by a user with a transmitter. However, the transmitter of the present invention may find use in various other applications where simple, inexpensive and compact transmitters are beneficially utilized.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A transmitter comprising:

means for generating a signal to be transmitted at a predetermined frequency;

a first radiating loop for receiving the signal to be transmitted from the means for generating and for developing said signal to be transmitted and thereby transmitting said signal to be transmitted;

a second radiating loop inductively coupled to said first loop;

a capacitor connected in series with said second loop and having a value such that said second loop and capacitor operate to cancel transmission of signals at harmonics of said predetermined frequency, wherein said first loop is an outer loop and said second loop is an inner loop inside said outer loop.

2. The transmitter according to claim 1, wherein said generating means comprises a SAW resonator.

3. The transmitter according to claim 1, wherein said transmitter operates in an automobile security system.

4. A transmitter comprising:

means for generating a signal to be transmitted at a predetermined frequency;

an outer loop printed onto a circuit board for receiving the signal to be transmitted from the means for generating and for developing said signal to be transmitted and thereby transmitting said signal to be transmitted;

an inner loop inductively coupled to said outer loop and printed onto said circuit board inside of said outer loop; and a capacitor connected in series with said inner loop and having a value such that said inner loop and said capacitor operate to cancel a transmission of signals at harmonics of said predetermined frequency.

5. The transmitter according to claim 4, wherein said generating means comprises a SAW resonator.

6. The transmitter to claim 4, wherein said transmitter operates in an automobile security system.

7. A method for generating a signal to be transmitted, comprising the steps of:

generating an oscillating signal at a predetermined frequency;

radiating said oscillating signal by a first loop;

canceling radiation of signals at harmonics of said predetermined frequency by utilizing a second loop inductively coupled to said first loop and placed in series with a capacitor having a capacitive value selected so as to place signals generated in said second loop 180° out of phase with said harmonics of said predetermined frequency, wherein said first loop is an outer loop and said second loop is an inner loop inside said outer loop.

8. The method according to claim 7, wherein said oscillating signal is generated by a SAW resonator.

9. The method according to claim 7, wherein said signal to be transmitted is for use in an automobile security system.

10. A transmitter comprising:

means for generating a signal to be transmitted at a predetermined frequency;

a first radiating loop for receiving the signal to be transmitted from the means for generating and for developing said signal to be transmitted and thereby transmitting said signal to be transmitted;

a second radiating loop having a gap;

a circuit element connected between said first loop and said second loop and having a value such that such second loop and circuit element operate to cancel transmission of signals at harmonics of said predetermined frequency.

11. The transmitter according to claim 10, wherein said first loop is an outer loop and said second loop is an inner loop inside said outer loop.

12. The transmitter according to claim 10, wherein said generating means comprises a SAW resonator.

13. The transmitter according to claim 10, wherein said transmitter operates in an automobile security system.

14. The transmitter according to claim 10, wherein said circuit element is a capacitor.

15. A method for generating a signal to be transmitted, comprising the steps of:

generating an oscillating signal at a predetermined frequency;

radiating said oscillating signal by a first loop;

canceling radiation of signals at harmonics of said predetermined frequency by utilizing a second loop with a gap coupled to said first loop by a circuit element having a value selected so as to place signals in said second loop 180° out of phase with said harmonics of said predetermined frequency.

16. The method according to claim 15, wherein said oscillating signal is generated by a SAW resonator.

17. The method according to claim 15, wherein said signal to be transmitted is for use in an automobile security system.

18. The method according to claim 15, wherein said circuit element is a capacitor.

19. A transmitter comprising:

a signal generator for generating a signal to be transmitted at a predetermined frequency;

an outer loop printed onto a circuit board for receiving the signal to be transmitted from the signal generator and for developing said signal to be transmitted and thereby transmitting said signal to be transmitted;

an inner loop inductively coupled to said outer loop and printed onto said circuit board inside of said outer loop;

a circuit element connected to said inner loop and having a value such that said inner loop and said circuit element operate to cancel a transmission of signals at harmonies of said predetermined frequency.

* * * * *